US006042482A

United States Patent [19]

Wilds

[11] Patent Number: 6,042,482

[45] Date of Patent: Mar. 28, 2000

[54] COLLAPSIBLE RAMP CONSTRUCTION FOR HANDICAPPED BOWLERS

[76] Inventor: Joseph A. Wilds, 12400 Wildlife Rd., Holt, Fla. 32564

[21] Appl. No.: 09/175,896

[22] Filed: Oct. 20, 1998

[51] Int. Cl.[7] ..... A63D 5/00

[52] U.S. Cl. ..... 473/107; 473/56; 273/120 R; 273/129 Q

[58] Field of Search ..... 473/106, 107, 473/55, 56; 273/120 R, 129 Q

[56] References Cited

U.S. PATENT DOCUMENTS 2,490,288 12/1949 Wickersham .
3,083,967 4/1963 Steel .
3,481,601 12/1969 Santora ..... 273/54
3,539,183 11/1970 Lieb .
3,866,917 2/1975 Ensmann et al. .
4,368,898 1/1983 Lay .
4,441,710 4/1984 Lay ..... 273/54 R
5,358,446 10/1994 Bergman ..... 473/56
5,358,447 10/1994 Erickson .

*Primary Examiner*—William M. Pierce
*Attorney, Agent, or Firm*—Henderson & Sturm

[57] ABSTRACT

A collapsible ramp construction 10 for physically challenged bowlers and including a contoured ramp unit 11 supported by a collapsible framework unit 12. The upper end of the ramp unit 11 is provided with a ball release unit 13 which includes a ball receiving member 40 operatively associated with an actuator member 46, wherein movement of the actuator member 46 will releasably engage a bowling ball 100 from the ball receiving member 40.

7 Claims, 2 Drawing Sheets

COLLAPSIBLE RAMP CONSTRUCTION FOR HANDICAPPED BOWLERS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of ramp devices to assist handicapped bowlers in general, and in particular to a collapsible ramp construction that includes a ball release unit.

2. Description of Related Art

As can be seen by reference to the following U.S. Pat. Nos. 3,481,601; 4,441,710; 5,358,446; and U.S. Pat. No. 5,358,447, the prior art is replete with myriad and diverse collapsible and stationary bowling ramps for physically challenged individuals.

While all of the aforementioned prior art constructions are more than adequate for the basic purpose and function for which they have been specifically designed, they are uniformly deficient with respect to their failure to provide a simple, efficient, and practical collapsible bowling ramp construction which not only has a unique collapsible support unit but which also limits the amount of physical exertion that has to be provided by the physically challenged bowler.

Unfortunately, the prior art constructions all require more than a minimal amount of effort on the part of the physically challenged individual, and as a result many such individuals cannot participate in this very enjoyable sport.

As a consequence of the foregoing situation, there has existed a longstanding need for a new and improved type of bowling assistance ramp for handicapped bowlers that also includes a ball release unit that limits the amount of physical energy exerted by the bowler, and the provision of such a construction is a stated objective of the present invention.

BRIEF SUMMARY OF THE INVENTION

Briefly stated, the collapsible ramp construction that forms the basis of the present invention comprises in general a ramp unit, a collapsible framework unit, and a ball release unit.

As will be explained in greater detail further on in the specification, the ramp unit includes a pair of ramp arms having an upper end, a lower end, and an intermediate portion wherein the collapsible framework unit is operatively associated with the upper end and intermediate portion of the ramp arms.

Furthermore, the ball release unit includes a ball receiving member and an actuator member operatively associated with one another and pivotally connected to the upper end of the ramp unit wherein the movement of the actuator member will release a bowling ball from the ball receiving member so that the bowling ball will roll down the ramp unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
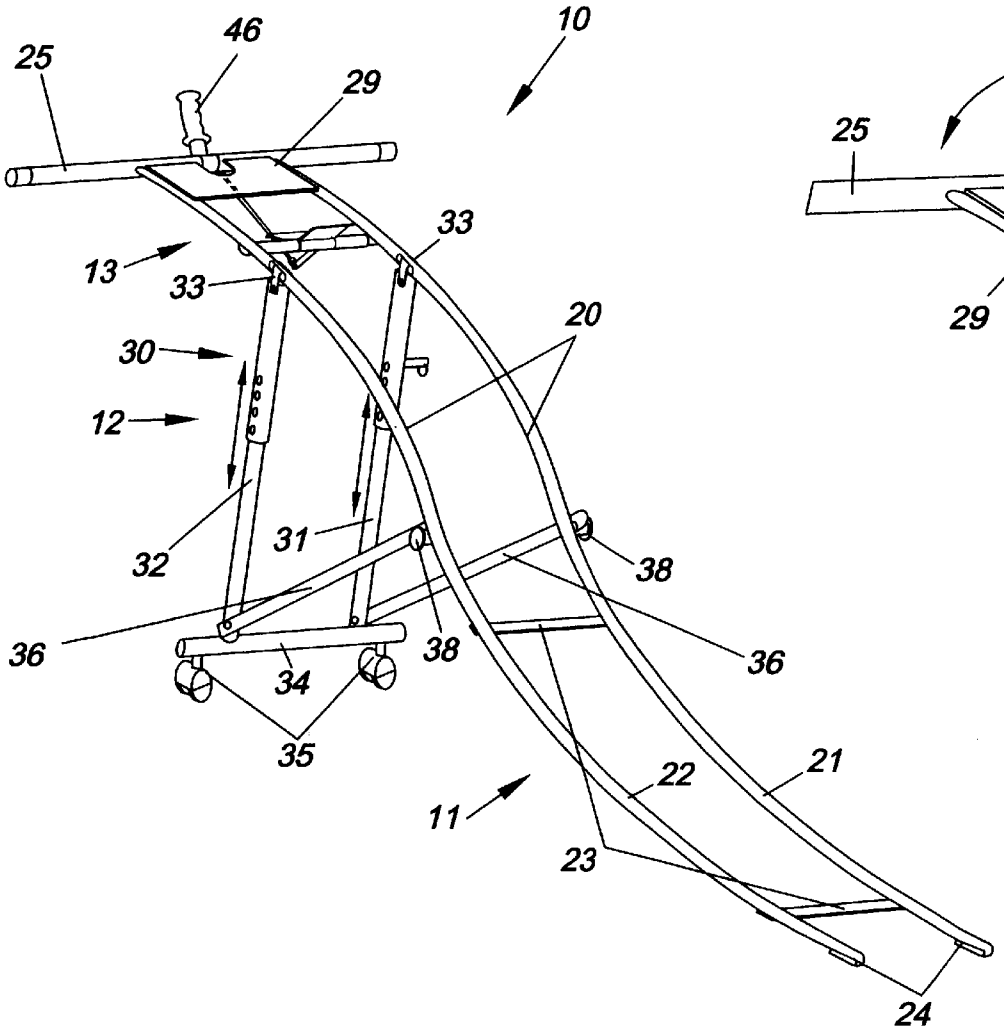
FIG. 1 is a perspective view of the collapsible bowling ramp construction that forms the basis of the present invention.

As can be seen by reference to the drawings, and in particularly to FIG. 1, the collapsible ramp construction that forms the basis of the present invention is designated generally by the reference number 10. The ramp construction 10 comprises in general a ramp unit 11, a collapsible support unit 12, and ball release unit 13. These units will now be described in seriatim fashion.

As shown in FIG. 1, the ramp unit 11 comprises an elongated curved ramp member 20 including a pair of inverted S-shaped ramp arms 21, 22 connected together by a plurality of cross brace elements 23 and dimensioned to accommodate the lower portion of a bowling ball.

In addition, the lower end of the ramp arms 21, 22 are provided with friction pads 24 and the upper end of the ramp arms 21, 22 are provided with an elongated transverse handle element 25 whose purpose and function will be described in greater detail further on in the specification and a ball support platform 29 is disposed adjacent to the handle element 25.

Still referring to FIG. 1, it can be seen that the collapsible support unit 12 comprises a collapsible support member 30 including a pair of telescoping support legs 31, 32 pivotally secured on their upper ends as at 33 to the upper portion of the ramp arms 21, 22. The lower ends of the support legs 31, 32 are provided with a cross piece element 34 provided with a pair of swiveling wheel elements 35 on the outboard end of the cross piece element 34.

In addition, the collapsible support member 30 also comprises a pair of brace arms 36 pivotally secured as at 37 on their lower ends to the lower portion of the support legs 31, 32. The upper ends of the brace arms 36 are releasably connected as at 38 to the intermediate portion of the ramp arms 21, 22.

Figure 2:
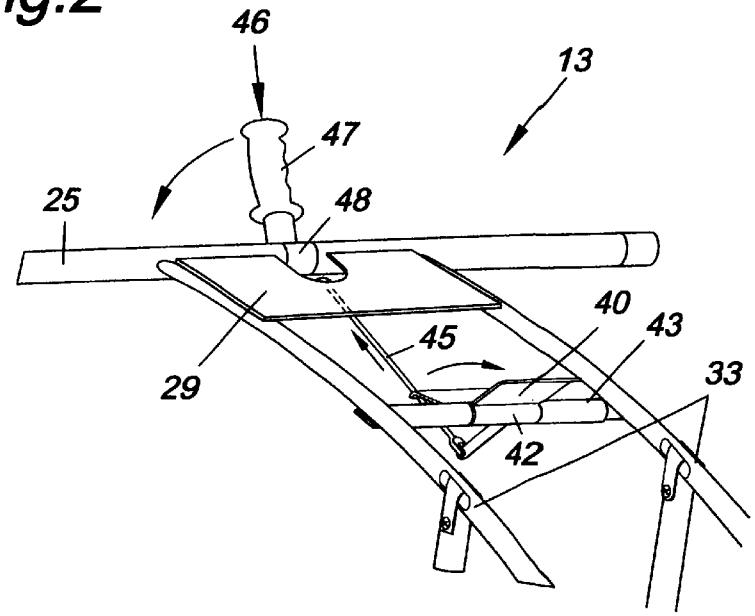
FIG. 2 is an enlarged detail view of the ball capturing and release unit.
Figure 5:
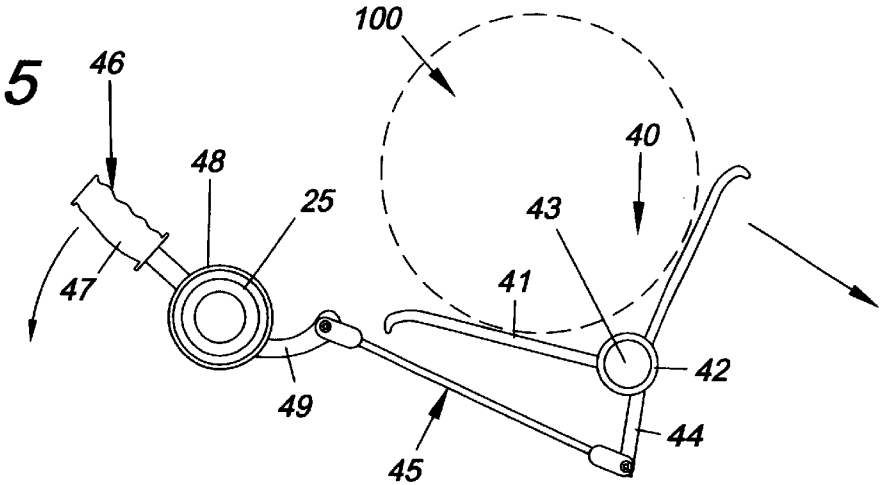
FIG. 5 is an enlarged side detail view of the ball capturing and release mechanism.

Turning now to FIGS. 2 and 5, the ball release unit 13 comprises a generally Y-shaped ball receiving member 40 having an upper generally V-shaped ball receptacle element 41 provided on the lower end with a first cylindrical collar element 42 rotatably suspended on a cross arm 43 fixedly secured to the ramp arms 21, 22 wherein the lower end of the cross arm 43 is provided with a rearwardly angled stem element 44.

As can best be seen by reference to FIG. 5, the ball release unit 13 further includes a linkage member 45 which operatively connects the ball receiving member 40 to an actuator member 46 which is rotatably suspended on the elongated handle element 25.

The actuator member 46 in turn includes a hand grip element 47 fixedly secured to a second collar element 48 rotatably disposed on the handle element 25 and having a curved lever arm 49 projecting forwardly from the lower portion of the second collar element 25. The outboard end of the lever arm 49 is pivotally secured to one end of the linkage member 45 and the other end of the linkage member 45 is pivotally secured to the stem element 44.

In operation, the user would use the elongated handle element 25 to position the framework unit 11 at a desired location behind the foul line of a bowling lane such that the ramp arms 21, 22 are disposed on the opposite sides of the intended line of flight of the bowling ball 100.

At this juncture, the user could also raise or lower the telescoping support legs 31, 32 to raise or lower the upper end of the ramp arms 21, 22 to increase or decrease the angle of inclination of the ramp arms 21, 22 which will have a corresponding effect on the speed of the bowling ball 100 as it rolls down the ramp arms 21, 22.

Once the ramp unit 11 and collapsible support unit 12 have been properly positioned, the user would move the bowling ball 100 into the ball receptacle element 41 then by grasping the hand grip element 47 and pulling rearwardly the ball receptacle element 41 would be rotated in a clockwise direction to propel the bowling ball 100 down the ramp arms 21, 22 in the direction of the bowling pins (not shown).

Figure 4:
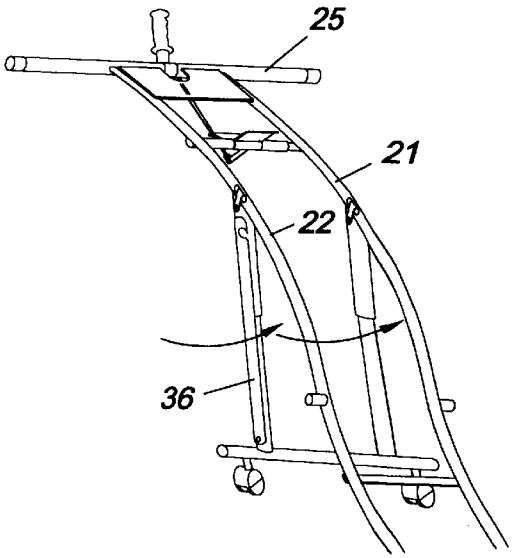
FIG. 4 is a perspective view of the support unit in the substantially collapsed mode.
Figure 3:
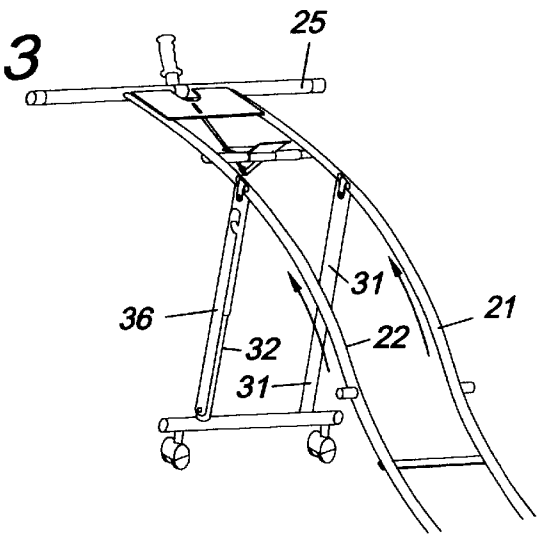
FIG. 3 is a perspective view showing the initial collapsing configuration of the support unit.

Turning now to FIGS. 3 and 4, it can be seen that in order to collapse the framework unit 12 all that is required is to releasably detach the upper ends of the brace arms 34 from the intermediate portion of the ramp arms 21, 22 and pivot the brace arms 34 to a position adjacent the support legs 31, 32. Then the support legs 31, 32 can be pivoted upwardly in the direction of the intermediate portion of the ramp arms 21, 22.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A collapsible ramp construction for physically challenged bowlers comprising:

a ramp unit including a ramp member having a pair of contoured ramp arms connected together by a plurality of cross brace elements wherein the ramp arms have an upper end, a lower end and an intermediate portion; and wherein the upper end of the ramp arms are provided with an elongated transverse handle element;

a framework unit operatively associated with the ramp unit and including a pair of support legs pivotally attached on their upper ends to the upper end of the ramp arms;

a ball release unit operatively associated with the upper end of said ramp arms and including a ball receiving member pivotally associated with the upper end of the ramp arms and dimensioned to engage a bowling ball relative to the upper end of the ramp arms wherein the ball receiving member further includes an actuator member connected to the ball receiving member by a linkage member pivotally secured on one end to the ball receiving member and pivotally secured on the other end to the actuator member; and means for releasably engaging the bowling ball from the ball receiving member.

2. The construction as in claim 1 wherein each of the support legs are telescopically adjustable.

3. The construction as in claim 1 wherein each of said support legs are provided with a brace arm which is pivotally connected on one end with one of the support legs; wherein, the other end of the brace arm is releasably connected to the intermediate portion of one of the ramp arms.

4. The construction as in claim 1 wherein the lower end of ramp arms are provided with friction pads.

5. The construction as in claim 1 wherein the actuator member is pivotally connected to said elongated transverse handle element.

6. The construction as in claim 1 wherein the lower end of each of the support legs are further provided with a cross piece element.

7. The construction as in claim 6 wherein the opposite ends of the cross piece element are provided with swiveling wheel elements.

* * * * *